United States Patent [19]

Wheeler

[11] 4,058,869

[45] Nov. 22, 1977

[54] SCRUBBING APPARATUS FOR POTTERY GREENWARE

[75] Inventor: Howard R. Wheeler, Crooksville, Ohio

[73] Assignee: Nelson McCoy Pottery Company, Roseville, Ohio

[21] Appl. No.: 651,459

[22] Filed: Jan. 22, 1976

[51] Int. Cl.[2] ..... A47L 15/38

[52] U.S. Cl. ..... 15/101; 15/211; 15/244 R; 15/230

[58] Field of Search ..... 15/56, 70–73, 15/75, 76, 101, 104.9, 164, 211–213, 244 R, 230, 97 R, 104, 165

[56] References Cited

U.S. PATENT DOCUMENTS

| | | | |
|---|---|---|---|
| 620,250 | 2/1899 | Pira | 15/75 |
| 1,274,909 | 8/1918 | Linderme | 15/213 X |
| 2,671,916 | 3/1954 | Zipperlin | 15/56 |
| 2,690,631 | 10/1954 | Peterson | 15/230 |
| 2,772,429 | 12/1956 | Lyman | 15/76 |
| 3,114,924 | 12/1963 | Morrison | 15/97 R |
| 3,195,158 | 7/1965 | Scholtus | 15/56 |
| 3,336,622 | 8/1967 | Kullwitz | 15/97 B X |
| 3,717,898 | 2/1973 | Jones | 15/244 R |
| 3,913,163 | 10/1975 | Durham | 15/75 |

FOREIGN PATENT DOCUMENTS

| | | | |
|---|---|---|---|
| 586,144 | 12/1958 | Italy | 15/101 |

*Primary Examiner*—Edward L. Roberts
*Attorney, Agent, or Firm*—Mahoney & Stebens

[57] ABSTRACT

An apparatus and method is provided for removal of debris and excess material from pottery greenware. The apparatus includes a vertically disposed spindle which is rotatably driven and carries surface abrading means secured to the uppermost end thereof. This abrading means comprises a body of resiliently flexible material such as a sponge which has a substantial number of pores or open spaces and voids distributed throughout its entirety. The abrading means projects radially outward from diamatrically composed sides of the spindle as well as extending a distance above the upper end thereof, thereby forming a surface which, when revolved about the vertical axis, defines a surface that readily conforms to that of the greenware to be scrubbed or cleaned. A water dispensing nozzle is also situated in close proximately to the upper end of the spindle and continuously ejects a stream of water onto or in the direction of the abrading means during operation of the apparatus. The method of utilization of this apparatus is that an article of greenware is temporarily positioned by the operator on the upper end of the spindle in contacting engagement with the surface of the abrading means and then removed for inspection. During the times that the article is removed from the spindle, the water supply is directed onto the abrading means and concurrently removes particles of greenware that have adhered to the surface or trapped in the pores and replenishes the supply of fluid carried by the abrading means for subsequent operations.

5 Claims, 4 Drawing Figures

SCRUBBING APPARATUS FOR POTTERY GREENWARE

BACKGROUND OF THE INVENTION

Various types of apparatus have heretofore been provided to facilitate the removal of excess material from the surface of pottery greenware prior to firing of the pottery. A cleaning or scrubbing operation is required to also smooth surfaces of the greenware and remove particles of debris that have accumulated during the molding and forming operations. Such known prior art apparatus utilized for this purpose has generally comprised a rotor or wheel having a number of abrading devices secured to the outer perimeter thereof in angularly-spaced relationship. The abrading devices utilized on the prior art apparatus are most often bodies of material that are substantially porous and resiliently flexible such as sponges. The sponges are secured at one end in respective grooves formed in the outer peripheral surface of the rotor or wheel with the outer end or free end operative to engage and remove particles from the surfaces of the greenware. A disadvantage of this type of device is that it is a relatively large structure and is not capable of being utilized for the interior of many forms and styles of pottery shapes. Its relatively large diametrical dimension prohibits the rotor from being inserted through the narrow neck or between the narrowly spaced side-walls of many forms of pottery. Additionally, the mounting of sponges in this manner results in a relatively rapid wearing which requires frequent replacement of the sponges. In fact the wearing rate is so substantial that in the normal course of usage, the sponges are often sufficiently worn to a point that they must be replaced two or three times during a single working day.

SUMMARY OF THE INVENTION

In accordance with this invention a novel apparatus and method is provided for effective and efficient cleaning of pottery, particularly the interiors of articles of pottery that have heretofore been capable of being cleaned by strictly manual operations. This apparatus comprises a vertical spindle which carries abrading means mounted on the uppermost end thereof. This abrading means is fabricated from a spongelike material which is resiliently flexible and has a large number of pores or voids formed therein. It is configured to extend a predetermined distance radially outward from either side of the spindle and to also project a distance upperwardly above the spindle. This results in a continuous surface line extending from one side of the spindle to the other side which, as the spindle revolves, results in a complete surface of revolution that is suitable for abrading and removing the excess material from surfaces of greenware. It is a surface that is readily capable of conforming to arcute or irregular interior surfaces of articles of pottery.

A supply of water is provided by apparatus which includes a nozzle for directing a stream of water into the general region of and onto the abrading sponge. This stream of water replenishes the fluid carried by the sponge and thereby facilitates the cleansing operation and most importantly, is useful in removing particles of debris and material that has been collected and accumulated in the pores of the sponge. This cleansing operation effectively rejuvenates the sponge and permits extended and continued operation. It has been found that sponges in this apparatus will last for the course of the complete working day.

Operation of the apparatus is such that with the spindle rotating, an article of greenware is brought into engagement with the abrading means for a period of time to remove the particles of debris and excess material such as that formed at parting lines. At intervals the operator removes the article of greenware not only for inspection as to satisfactory completion of the scrubbing and cleaning operation but to permit the water stream to flow onto the sponge and perform the rejuvenating and cleansing operations on the sponge. After permitting the fluid to flow onto the sponge, the operator can then either replace the article of greenware if further cleansing is required or another piece of pottery may be substituted and subjected to the same operation.

These and other objects and advantages of this invention will be readily apparent from the following detailed description of an embodiment thereof and the accompanying drawings showing that embodiment.

DESCRIPTION OF THE DRAWING FIGURES

DETAILED DESCRIPTION OF THE ILLUSTRATED EMBODIMENT

Figure 1:
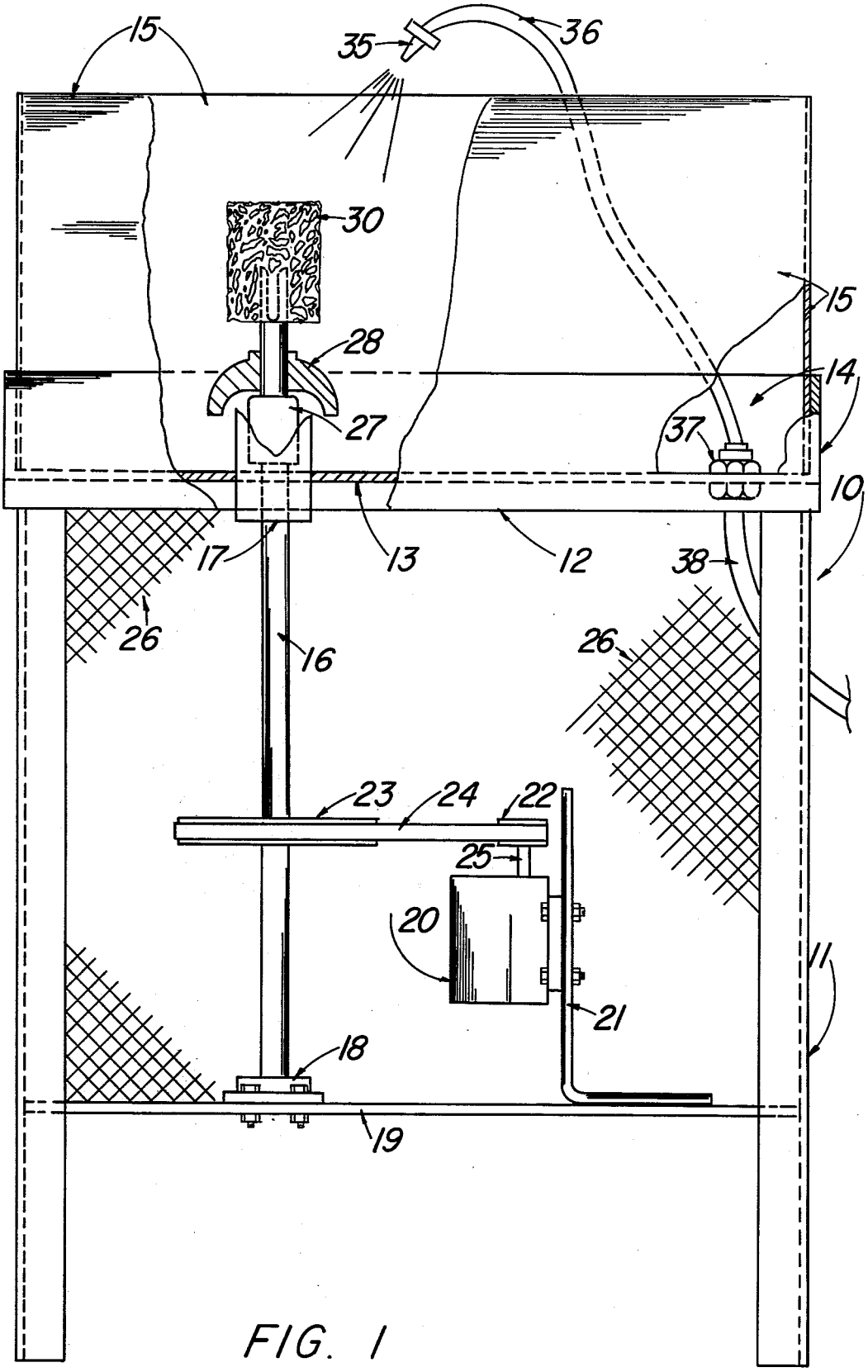
FIG. 1 is a side-elevational view of the apparatus with portions thereof broken away to better illustrate the spindle and abrading means.

Having reference specifically to FIG. 1, an embodiment of the apparatus is shown in side elevation. This apparatus includes a base frame 10 which includes four upstanding legs 11 carrying a table-like top 12 at the upper end. This top 12 includes a rectangularly shaped base member or bottom wall 13 which is surrounded on all sides by upstanding sidewalls 14. Since the apparatus is utilized with fluids, as previously indicated, these sidewalls 14 are secured to the bottom wall 13 to form a fluid-tight enclosure or pan for receiving and containing this fluid. Each of the side walls 14 is provided with upward projecting extensions 15 to more effectively contain the fluid that is sprayed onto the article of greenware of the abrading means. These upward extensions 15 are not necessarily of the same structural strength as the side walls 14 of the tabletop 12 since they serve primarily as fluid deflectors.

Mounted on and supported by the base frame 10 is an upstanding spindle 16 which is journaled in upper and lower bearing housings 17 and 18. The lower bearing housing 18 is mounted on a shelf 19 which is secured to and carried by the upstanding legs 11. A rotational driving force is applied to the spindle 16 by an electric motor 20 which is also supported on the shelf 19 by an L-shaped bracket 21. A driving connection between the motor and spindle 16 is provided by means of a pair of pulleys 22 and 23 interconnected by a belt 24. The pulley 22 which is mounted on a driveshaft 25 of the motor 20 is relatively smaller than the pulley 23 which is secured to the spindle 16. The relative sizes of the two pulleys 22 and 23 is determined by the speed reduction required to drive the spindle and the abrading means at an optimum speed. It will also be noted that a protective screening 26 is applied to and encloses the lower portion of the base frame to prevent injury to the operator by the drive mechanisms carried by the base frame.

The upper bearing housing 17 extends through the table top 12 and is fixed to the bottom wall 13. It will be noted that the spindle is laterally offset to the left of center of the table as viewed in FIG. 1 and is located depthwise at approximately the mid-point in front to back relationship. This has been found to be the preferred location for the spindle to most effectively facilitate use by the operator in cleaning of greenware. It will also be noted that the upper housing 17 projects a distance above the uppermost surface of the bottom wall 13 to provide protection from the fluids that accumulate in the table top 12. A spindle bearing 27 is secured in this housing 17 and a protective shield 28 is fixed on the spindle immediately above the bearing. This protective shield 28 is circularly configured and of a radius to extend substantially beyond the bearing housing 17. Fluids easily drain off from the shield 28 as the upper surfaces thereof are configured to slope downwardly and outwardly.

Figure 2:
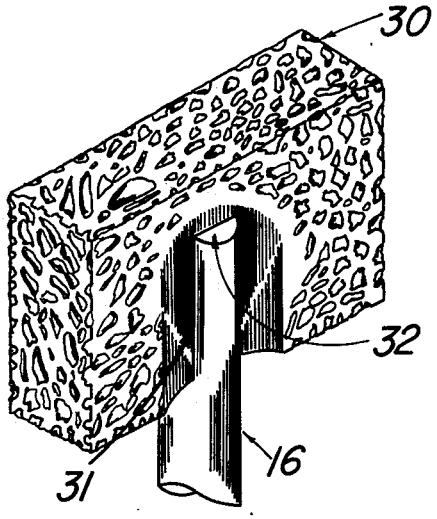
FIG. 2 is a perspective view on an enlarged scale of the upper end of the spindle and showing the abrading means.

Mounted on the upper end of the spindle 16 is the abrading means 30. In accordance with this invention the abrading means is preferably formed from a sponge-like material which has a substantial number of pores or voids throughout the body thereof. The material selected for the abrading means is resiliently flexible with the flexibility further enhanced by the pores formed in the material. As can be best seen in FIG. 2, the abrading means is relatively elongated and of rectangular cross section. The length of the block of material is substantially greater than that of the spindle with the free ends of the sponge thus extending a distance outward from the spindle.

Mounting of the sponge is conveniently effected by means of a slot 31 formed in the upper marginal end portion end of the spindle 16. This slot 31 has vertically extending side-walls which are spaced apart a distance substantially less than the thickness of the sponge that is to be inserted therein. In addition, the length of the slot 31 is substantially less than the vertical dimension of the sponge thus resulting in a portion of the sponge projecting a distance above the upper end of the spindle. Mounting of the sponge 30 is effected by compressing the central portion thereof to a thickness less than the spacing of the slot-walls and forcing this compressed portion into the slot 31 where it is securely retained. This procedure is facilitated by slightly rounding the upper ends 32 of the spindle at each side of the slot. Since, during operation of the apparatus, the greenware is positioned on and forced downwardly onto the sponge 30; no other means is required to secure the sponge in the slot 31.

A fluid is continuously supplied to the sponge and the greenware that may be intermittently positioned on the sponge during the course of operation of the apparatus. This fluid, which is usually water, is supplied by means of a nozzle 35 that is positioned in a pre-determined location relative to the upper end portion of the spindle. As shown in FIG. 1, the nozzle 35 is located above and at a 45° angle to the spindle to obtain the most effective application of the water, while maintaining the nozzle out of the operator's way during normal manipulation of greenware articles.

Supporting the nozzle 35 is a supply pipe 36 which is secured to a connector fitting 37 passing through the bottom wall 13 of the table top. Forming the supply pipe 36 from a flexible conduit facilitates proper positioning of the nozzle 35. Also connecting with the connector fitting 37 is a flexible hose 38 which in turn connects with a suitable source of water under the prescribed pressure. Valve means, not shown, may be incorporated in the fluid supply line as necessary to facilitate operation of the apparatus.

Figure 3:
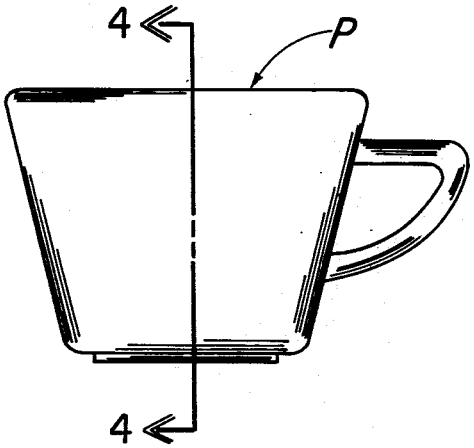
FIG. 3 is a side-elevational view of an article of pottery.
Figure 4:
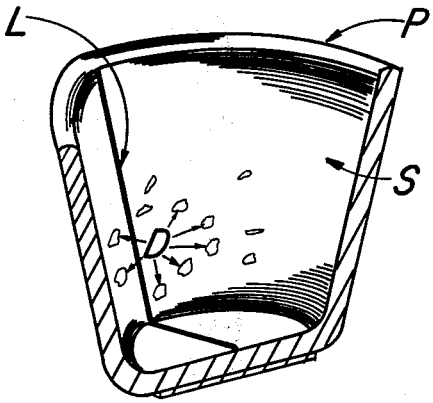
FIG. 4 is a sectional perspective view taken along line 3—3 of FIG. 3.

Operation of the apparatus will be readily understood by reference to several figures of the drawings including FIGS. 3 and 4 which illustrate a representive embodiment of an item of pottery greenware which requires cleaning. This item of pottery P is a cup having an internal surface S. In the formation of a pottery article although not necessarily in the case of a cup, there may be a parting line L as well as particles of debris D adhering to various portions of the internal surface S. With the apparatus of this invention operating, that is, the motor 20 energized and driving the spindle 16 at the pre-determined speed, the operator merely places the article of pottery greenware such as the cup P in an inverted manner over the sponge 30. Prior to this time, the water supply has been connected and directing a spray of water in the general direction of the sponge 30. This will have removed previously accumulated particles of debris or excess material from the sponge and replenished the supply of water carried in the pores of the sponge.

With the article of pottery held inverted over the sponge and maintained in forceful engagement therewith, the rotation of the sponge 30 will gently abrade the interior surface S of the article. The inherent flexibility and resilience of the sponge enables the sponge to readily project into irregularly shaped corners or surfaces to readily reach the parting line and the particles of debris that may be present. At intervals, the operator may remove the article for inspection and determine whether additional cleaning may be required. During the time that the article is removed from the sponge, it will be noted that the water continues to emit from the nozzle 35 and again rejuvenates the sponge through removal of particles of debris that have accumulated in the pores as well as replenishing the supply of water in the pores for subsequent pottery cleaning operations. Although rotation of the spindle will cause the sponge to eject particles of debris, as well as water, the upward extensions 15 of the sidewalls effectively prevent this material from being indiscriminately scattered about the room and onto the operator. It will also be understood that the sponge will be worn during the course of use and will become relatively irregularly shaped but this does not detract from its useful operation until the wear is excessive.

It will be readily apparent from the forgoing description of the illustrated embodiment of the apparatus and the method of operation that a novel apparatus has been provided for enhanced cleaning of articles of pottery greenware. The sponge abrading means 30 is particularly effective in performing the cleaning operation and its method of mounting permits its utilization in the interior cleaning of pottery items having difficult to reach or irregular surfaces, as well as those having relatively narrow necks. This mounting of the sponge also greatly facilitates replacement of the sponge and the expected life is greatly extended over that of the prior art apparatus. Also, while the apparatus of this invention is specifically intended for interior cleaning operation, it will be readily apparent that the apparatus may be utilized to advantage in exterior cleaning operations.

Having thus described this invention, what is claimed is:

1. Apparatus for internal cleaning of pottery greenware comprising an upstanding spindle mounted for rotation about a vertical axis and including drive means mechanically coupled therewith for revolving the spindle at a predetermined speed, surface abrading means secured to said spindle at the upper end to be revolved therewith, said spindle formed with an axially extending slot opening transversely of said spindle and at the upper end thereof, said abrading means being a body formed from a resiliently flexible material which is relatively porous with said body projecting radially outward from opposed sides of said spindle and having a body thickness substantially greater than the width of said slot so as to project a distance above the upper end of said spindle and compressible in the central region to frictionally interfit in said slot.

2. Apparatus according to claim 1 wherein said abrading means is a sponge.

3. Apparatus according to claim 1 which includes fluid dispensing means oriented relative to said spindle for directed a stream of fluid onto said abrading means.

4. Apparatus according to claim 3 wherein said fluid dispensing means includes a nozzle connected in fluid communicating relationship with a source of pressurized fluid.

5. Apparatus according to claim 1 which includes an open-topped, fluid container having a bottom wall with said spindle projecting upwardly there through and peripheral side walls in spaced relationship to said spindle permitting application of an article of greenware to said abrading means, said side walls extending a distance above the uppermost extremity of said abrading means.

* * * * *